US005366083A

United States Patent [19]

Sos et al.

[11] Patent Number: 5,366,083

[45] Date of Patent: Nov. 22, 1994

[54] PACKING AND STORING RECEPTACLE, PARTICULARLY FOR KNITTING MACHINE NEEDLES

[75] Inventors: Siegmund Sos; Artur Hoch, both of Albstadt, Germany

[73] Assignee: Theodor Groz & Söhne & Ernst Beckert Nadelfabrik Commandit-Gesellschaft, Albstadt, Germany

[21] Appl. No.: 92,424

[22] Filed: Jul. 16, 1993

[30] Foreign Application Priority Data

Jul. 17, 1992 [DE] Germany ..... 9209580[U]

[51] Int. Cl.[5] ..... B65D 85/24

[52] U.S. Cl. ..... 206/380; 206/443

[58] Field of Search ..... 206/380–383, 206/472–483, 485, 486, 488, 443

[56] References Cited

U.S. PATENT DOCUMENTS

| | | | |
|---|---|---|---|
| 1,391,287 | 9/1921 | Waldes | 206/482 |
| 1,634,096 | 6/1927 | Doscher | 206/382 |
| 1,879,952 | 9/1932 | Rosen | 206/476 |
| 1,930,311 | 10/1933 | Gittleman | 206/482 |
| 2,295,242 | 9/1942 | Slingsby | 206/380 |
| 2,305,922 | 12/1942 | Finkelstein . | |
| 2,771,187 | 11/1956 | Haile . | |
| 3,014,582 | 12/1961 | Crane . | |
| 3,272,328 | 9/1966 | Krzyanowski | 206/482 |
| 3,452,859 | 7/1969 | Hofmann . | |
| 4,331,287 | 5/1982 | Wharton . | |
| 4,332,322 | 6/1982 | Jaeschke et al. | 206/485 |
| 4,386,697 | 6/1983 | Zocher . | |
| 4,637,512 | 1/1987 | Smith | 206/383 |
| 4,993,547 | 2/1991 | Pallasch et al. | 206/482 |
| 5,197,597 | 3/1993 | Leary et al. | 206/482 |

FOREIGN PATENT DOCUMENTS

| | | | |
|---|---|---|---|
| 0159213 | 10/1954 | Australia | 229/125.37 |
| 0537282 | 2/1957 | Canada | 206/380 |
| 621788 | 11/1933 | Germany . | |
| 1536055 | 5/1971 | Germany . | |
| 2639029 | 3/1978 | Germany . | |
| 8515483 | 8/1985 | Germany . | |
| 9114139 | 3/1992 | Germany . | |
| 9200210 | 4/1992 | Germany . | |
| 9206368 | 9/1992 | Germany . | |
| 0398232 | 9/1933 | United Kingdom | 206/382 |

*Primary Examiner*—Jimmy G. Foster

*Attorney, Agent, or Firm*—Spencer, Frank & Schneider

[57] ABSTRACT

A packing and storing receptacle includes a bottom panel and a top panel superposed on the bottom panel and defining a pouch therewith for receiving at least a longitudinal part of the contents. The bottom and top panels are formed by a single, flexible sheet and are separated from one another by a transverse folding edge defining an end of the receptacle. The top panel has a terminal edge remote from the transverse folding edge and defining, together with the bottom panel, a removal opening of the pouch. The bottom and top panels have longitudinal lateral edges extending generally perpendicularly to the transverse folding edge along the length of the receptacle. There are also provided lateral and/or transverse tabs cut out, bent out from and integrally attached to the flexible sheet for laterally guiding and positioning the contents. The longitudinal lateral edges of the bottom panel are directly and/or indirectly connected to the longitudinal lateral edges of the top panel at transversely opposite zones.

17 Claims, 5 Drawing Sheets

PACKING AND STORING RECEPTACLE, PARTICULARLY FOR KNITTING MACHINE NEEDLES

CROSS REFERENCE TO RELATED APPLICATION

This application claims the priority of German Application No. G 92 09 580.1 filed Jul. 17, 1992, which is incorporated herein by reference.

BACKGROUND OF THE INVENTION

This invention relates to a packing and storing receptacle, particularly for knitting machine needles. The receptacle is of the type which has an essentially planar bottom wall and a top wall which is oriented essentially parallel to the bottom wall and which is connected to the bottom wall and defines therewith a receiving space for at least one needle packet. The receiving space has a removal opening at one end. The receptacle also has lateral guiding and positioning components for the needle packet situated in the receiving space.

Knitting machine needles of identical type are, as a rule, packaged in a side-by-side relationship to form small needle packets, each consisting of, for example, fifty needles. Conventionally, the needle packets are placed in small paper bags or envelopes which, in turn, are deposited in boxes delivered to the consumer. The introduction of the needle packets into the paper bags or envelopes is, on the one hand, uneconomical because it requires manual labor and, on the other hand, the removal of the needles by the consumer from the paper bags or envelopes is circumstantial and disadvantageous because after removing some needles, the remaining needles assume a random orientation in the pouch or envelope and thus the risks are high that they become entangled with one another.

German Patent 1,536,055 discloses a packing and dispensing receptacle for knitting machine needles that can be regarded as an improvement concerning the difficulties discussed above. The plastic receptacle disclosed in this patent—which may be considered as the starting point of the invention—has a bottom wall on which longitudinal sides, separating walls and an end wall are formed. The longitudinal sides, the bottom wall and the separating walls define needle compartments for receiving needle packets. The receptacle (housing) constructed in such a manner is open at that end which is opposite from the end wall. The needle compartments are closed by a top wall which is a cross-sectionally approximately U-shaped lid part formed of a flexible plastic component slidably received in grooves provided in the longitudinal side walls. The longitudinal sides and separating walls formed on the bottom wall as well as an upwardly bent, strip-like end piece formed on the top wall constitute lateral guiding and positioning components for the needle packets which are thus non-shiftably secured in the needle compartments.

For removing needles from such a prior art receptacle, the lid portion may be elastically bent away at its end so that the needles are exposed at their end and may be pulled out from the needle compartment through the removal opening provided at its end.

Such a multi-part plastic receptacle, however, is expensive to manufacture and is not readily adaptable for an automatic packaging of the knitting machine needles. It is a further disadvantage of this prior art construction that since the use of plastic material is a necessity, properly disposing of the empty plastic packaging receptacles poses an increasing problem and therefore the advisability to use such material is being questioned with increasing frequency.

SUMMARY OF THE INVENTION

It is an object of the invention to provide an improved packing receptacle for knitting machine needles which not only offers excellent protection for the delicate knitting needle parts of the needles (particularly the head and the needle latch), but provides for a facilitated needle removal, ensures an economical manufacture of the receptacle from inexpensive material and is so structured that an automated packaging process is readily feasible.

This object and others to become apparent as the specification progresses, are accomplished by the invention, according to which, briefly stated, the packing and storing receptacle includes a bottom panel and a top panel superposed on the bottom panel and defining a pouch therewith for receiving at least a longitudinal part of the contents. The bottom and top panels are formed by a single, flexible sheet and are separated from one another by a transverse folding edge defining an end of the receptacle. The top panel has a terminal edge remote from the transverse folding edge and defining, together with the bottom panel, a removal opening of the pouch. The bottom and top panels have longitudinal lateral edges extending generally perpendicularly to the transverse folding edge along the length of the receptacle. There are also provided lateral and/or transverse tabs cut out and/or bent out from and integrally attached to the flexible sheet for laterally guiding and positioning the contents. The longitudinal lateral edges of the bottom panel are directly and/or indirectly connected to the longitudinal lateral edges of the top panel at transversely opposite zones.

The generally rectangular flexible sheet (receptacle blank) is formed of a cardboard impregnated with a rust inhibiting agent. A packing receptacle made of such a material is environment friendly and may be easily and safely disposed of. If, for example, because of climatic conditions a cardboard may not be used, the receptacle may be formed of a multi-layer plastic sheet. In the packet the knitting machine needles are arranged in a stack in an edgewise standing orientation and are held between the lateral guiding and positioning components and the closed bottom of the pouch in a highly satisfactory manner. The knitting parts of the needles are accommodated in the pouch such that they are protected from all sides and further, they are elastically braced between the folded-over panels which form the bottom and the top receptacle wall. Such a clamped positioning of the needles constitutes an additional safety against undesired mutual displacements of the needles during transportation and further effectively prevents the needles remaining in the partial packet from assuming a random orientation.

The receptacle according to the invention may be made with a simple stamping and folding process and, simultaneously, the needle packets may be deposited fully automatically from a needle magazine.

As a rule, it suffices if the two portions (panels) of the blank which define the pouch are connected to one another in the zone of the longitudinal edges merely at limited locations. It is expedient if such connecting locations are situated in the vicinity of the edges which define the removal opening in order to increase the stability of the receptacle in this zone which is particularly exposed to stresses and loads during needle removal.

Particularly simple conditions may be ensured, even concerning manufacturing aspects, by providing, as panel connecting means, at least one adhesive strip which is secured at the connecting locations to both panels in the edge zones thereof and which surrounds the edge zones in a U-shaped manner. In the alternative or additionally, the two panels may be attached to one another at the connecting locations in dot-like or strip-like zones by gluing or mechanical stapling.

Particularly for the purpose of facilitating the removal of needles from the receptacle it is advantageous if, in the zone of the removal opening, one panel is shorter than the other, so that the longer panel has an exposed zone on which the needles may lie with their shank. Thus, the shank and butt portions of the needle—which portions are significantly less delicate than the knitting portions—are exposed, so that the needles may be easily grasped and pulled out of the receptacle.

At least one of the upwardly bent tabs which serve as guiding and positioning components is, as a rule, substantially parallel to the folding edge of the panels and faces the removal opening at the end of the associated needle packet in order to prevent the needles from accidentally sliding out of the pouch. For the lateral support of the needle packet there may be provided at least two upwardly bent tabs spaced at a distance which corresponds to the width of the needle packet and oriented transversely to the folding edge of the panels. Dependent upon the shape of the needle packet these tabs may be either at 90° or at another inclination to the folding edge. The latter arrangement is particularly of significance if the needle packet is formed of knitting machine needles which are thicker at their head portion than at their butt portion, so that the needle packet has a generally trapezoidal shape when observed in plan view.

The upwardly bent tabs are preferably formed by bending them out of the plane of the associated panel. They may be situated in the earlier-mentioned exposed panel zone at the removal opening or, at least some of the tabs may be situated within the pouch. These tabs may be received, if necessary for reinforcement, in openings (slots) of the other panel.

According to another advantageous embodiment of the invention, a flap which adjoins the end of the needle packet is folded to form a housing part which projects upwardly from the bottom wall (bottom panel) and which, at its side facing the removal opening of the pouch, has a receiving opening for the associated end region of the needle packet. Such housing portion advantageously has a substantially rectangular or quadratic cross-sectional outline; in principle, however, it may have another shape, for example, a triangular cross-sectional shape. The end region of the needle packet projects through the receiving opening into the inside of the housing portion and is thus securely received and held thereby. For this purpose, the lateral edges of the receiving opening may form lateral guiding and positioning components for the needle packet, or on the lateral edges of the receiving opening cut-out tabs may be provided which serve as lateral guiding and positioning components and which are folded into the inside of the housing portion. Such tabs have a certain own (inherent) elasticity so that within certain limits they automatically compensate for width variations of the needle packet while, at the same time, they facilitate the introduction of the needle packet into the receiving opening. The flap folded to form the housing portion may have at its end securing parts which are affixed to the bottom panel to thus obtain an overall stable construction. Such a housing portion has the following simultaneous functions:

The housing portion constitutes an abutment for the needle packet in the longitudinal direction and also, it functions as a lateral support for the needle packet and furthermore, it takes up the load if more such receptacles are stacked in superposition and are alternately turned 180° relative to one another. In this manner a stacked height of up to 500 mm or more may be achieved without any risk of adversely affecting the packages or the needles.

The receptacle according to the invention ensures that the needles are protected and held in a uniform manner. A receptacle structured according to the invention makes it possible to ship therein a single small needle packet which is often required when, for example, spare parts are to be delivered. In such a case it is advantageous to weld the needle-filled receptacle in an airtight, clear plastic sheet.

DESCRIPTION OF THE PREFERRED EMBODIMENTS

Figure 4:
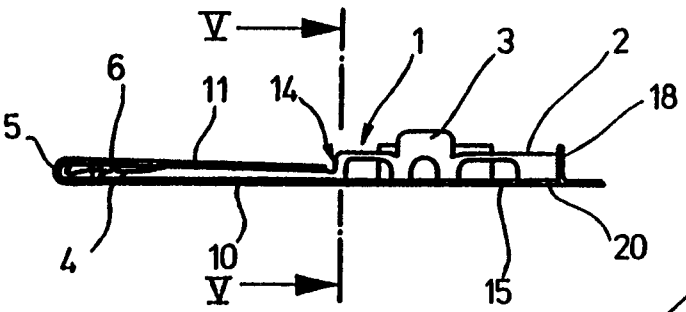
FIG. 4 is a sectional view taken along line IV—IV of FIG. 2.
Figure 5:
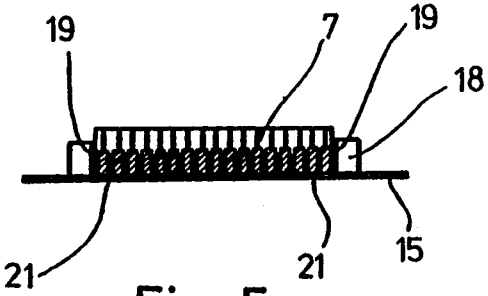
FIG. 5 is a sectional view taken along line V—V of FIG. 4.
Figure 9:
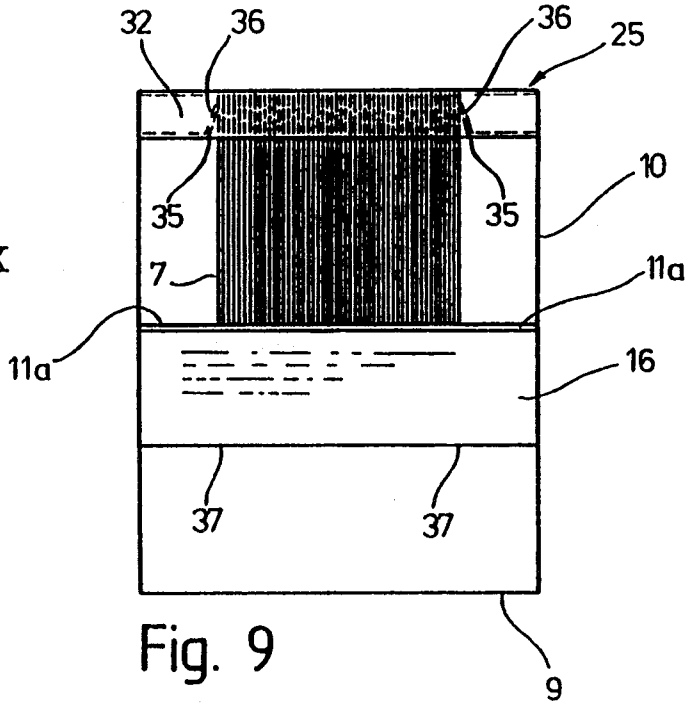
FIG. 9 is a top plan view of the construction shown in FIG. 8.
Figure 11:
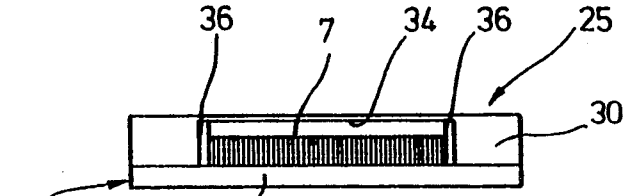
FIG. 11 is a front elevational view of the construction shown in FIG. 8, as seen in the direction of the arrow XI.

The receptacle illustrated in the Figures in four different preferred embodiments serves for packing and storing knitting machine needles 1 whose configuration may be seen, for example, in FIG. 4. Each needle has a needle shank 2 provided with a butt 3 and an adjoining, shallower, knitting part 4 which has a head (hook) 5 and a needle latch 6. The stamped-out knitting machine needles 1 are gathered into a needle packet 7 (FIG. 1) in which the needles are stacked in an edgewise upright orientation. One needle packet may include, for example, fifty, twenty-five or twenty knitting machine needles.

Figure 12:
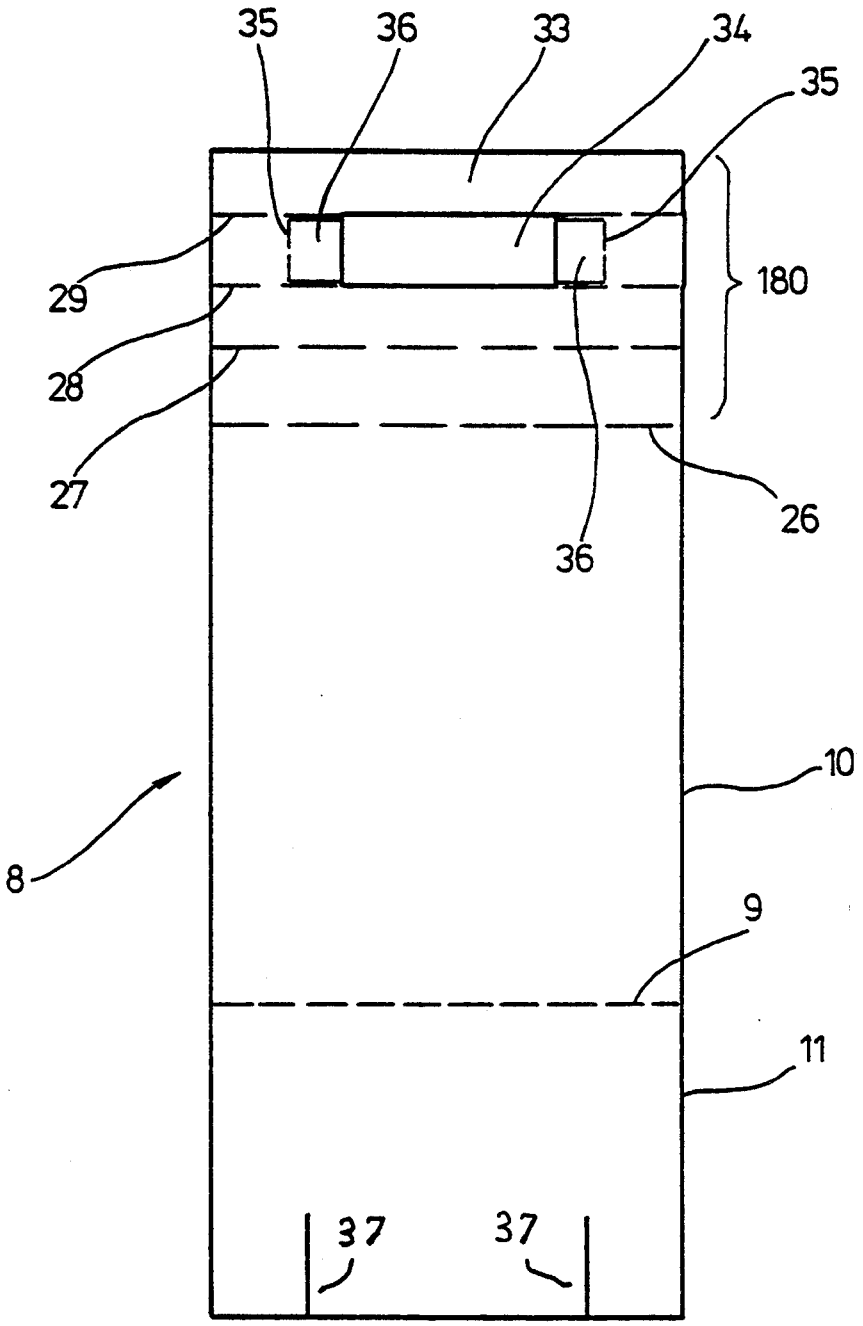
FIG. 12 is plan view of a blank for the structure shown in FIG. 8.

The receptacle proper is made from a thin, flexible blank which is an elongated, rectangular cardboard strip impregnated with a rust inhibiting agent. FIG. 12 shows such a blank which is designated at 8 and which, when appropriately folded, constitutes the receptacle according to FIGS. 8–11.

Referring to FIGS. 1–5, the blank is folded 180° about a transverse folding edge 9 onto itself whereby a longer bottom panel 10 and a shorter top panel 11 are formed which define a pouch 12 closed along the fold 9. The panel 10 constitutes a bottom wall or a needle carrier while the panel 11 forms a cover wall. The terminal edge 13 of the shorter receptacle panel 11 bounds a pouch opening (removal opening) 14 which is adjoined by an exposed zone 15 of the bottom panel 10. In the zone of the removal opening 14 the two face-to-face arranged panels 10 and 11 are, along their longitudinal edges, locally attached to one another by means of a connecting component constituted by an adhesive strip 16 which is glued to the outer face of the top panel 11 and which is oriented transversely to the length dimension of the receptacle. The adhesive strip 16 extends, in a U-shaped manner, bilaterally to the outer face of the bottom panel 10. The adhesive strip 16 may be subdivided in the longitudinal or transverse direction and it is also feasible—additionally or in the alternative—to glue to one another marginal regions of the two panels 10, 11. Such dot-like or dash-like adhesive strips are designated at 17 in FIG. 1.

As a rule, the above-described, locally limited connection of the two panels 10 and 11 in the vicinity of the removal opening 14 is sufficient. If required, it is feasible to entirely close the pouch 12 by an appropriate extension of the connecting locations up to the fold 9 or to provide a plurality of spaced connecting locations along the length of the pouch. It is also feasible to place spacer strips at the edges between the two panels 10 and 11 and to affix them to the connecting locations.

Tabs 18 and 19 are cut and bent up 90° from the exposed zone 15 of the bottom panel 10. Tabs 18 and 19 constitute guiding and positioning components for the needle packet 7. As particularly well seen in FIGS. 1 and 2, the openings 20 and 21 in the panel 10 which were earlier filled out by the material now constituting the tabs 18 and 19 are situated essentially underneath the needle packet 7 and the tab 18 is oriented approximately parallel to the fold edge 9 and is situated along the frontal end of the needle packet 7 to abut the needle packet 7.

The other two tabs 19 are spaced from one another in the width direction of the receptacle; they are oriented essentially perpendicularly to the fold edge 9 and laterally support the needle packet 7. In case it is advisable—for example, because of the length of the knitting machine needles 1—to also support the needle packet 7 at the knitting portion 4, tabs which correspond to tabs 19 may also be provided in the zone of the pouch 12. Such tabs project into the receiving space for the needles.

Figure 2:
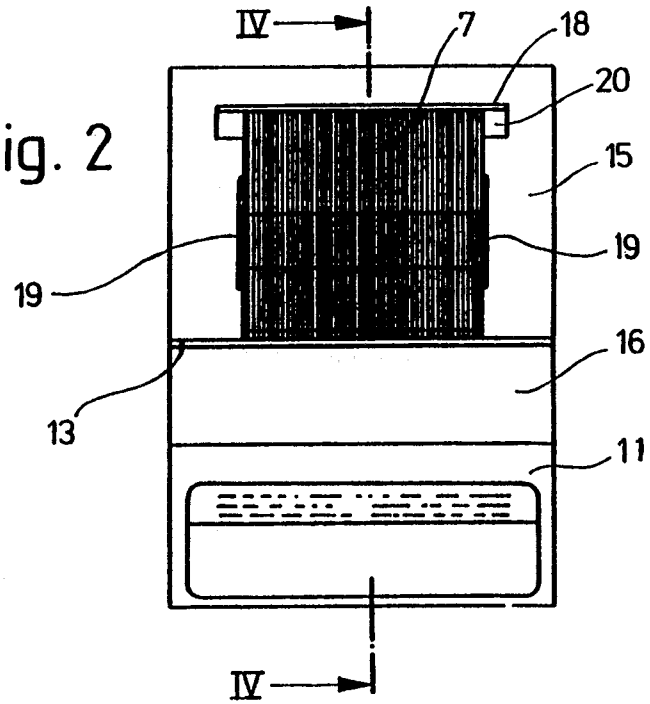
FIG. 2 is a top plan view of the structure shown in FIG. 1.
Figure 3:
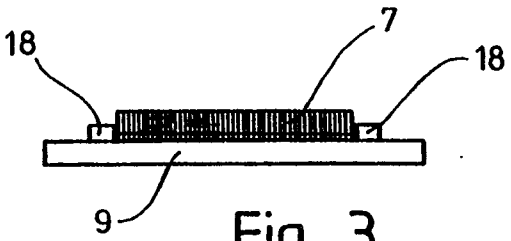
FIG. 3 is an end elevational view of the construction shown in FIG. 1 as viewed in the direction of the arrow III.
Figure 1:
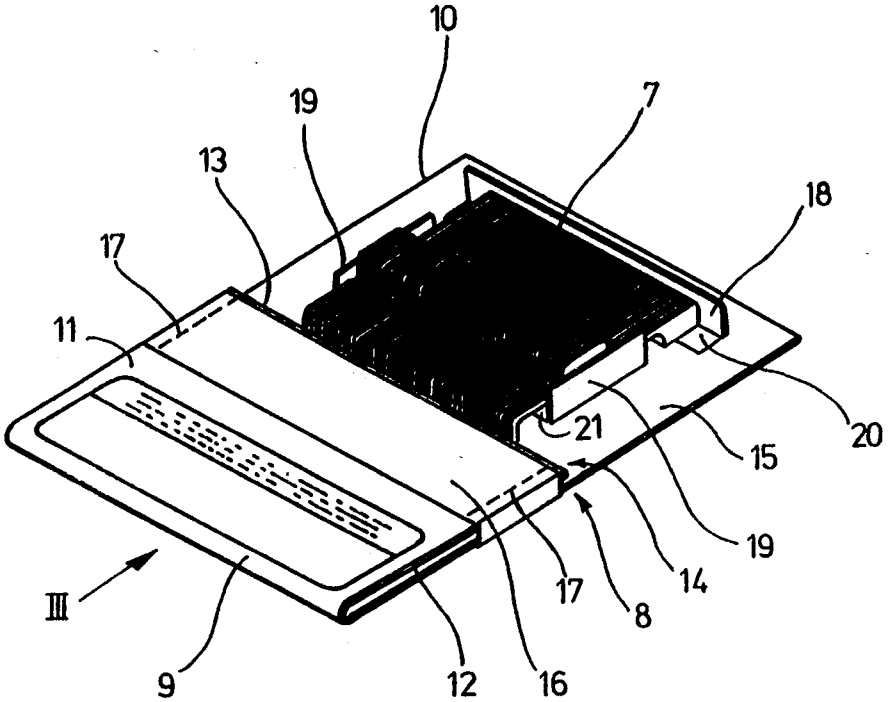
FIG. 1 is a perspective view of a receptacle according to a preferred embodiment of the invention, illustrated in a filled, ready-to-ship state.

The needle packet 7 may be subdivided into partial packets which are then positioned and supported between the tabs 18 and 19 as shown in FIG. 1.

The introduction of the knitting machine needles 1 into the receptacle may be effected fully automatically such that the individual needle packets are, prior to the folding over of the top panel 11, deposited from a magazine onto the bottom panel 10 which was provided in a previous process step with the upwardly bent tabs 18 and 19. Thereafter the top panel 11 is folded over onto the bottom panel 10 and subsequently the adhesive strip 16 is applied for completing the needle package. Since the needle packet 7 is narrower than the receptacle blank and the top panel 11 is bent against the bottom panel 10 during the application of the adhesive strip 16, the knitting machine needles 1 are, at their knitting ends 4, held elastically in the pouch 12 between the two panels 10 and 11.

Figure 7:
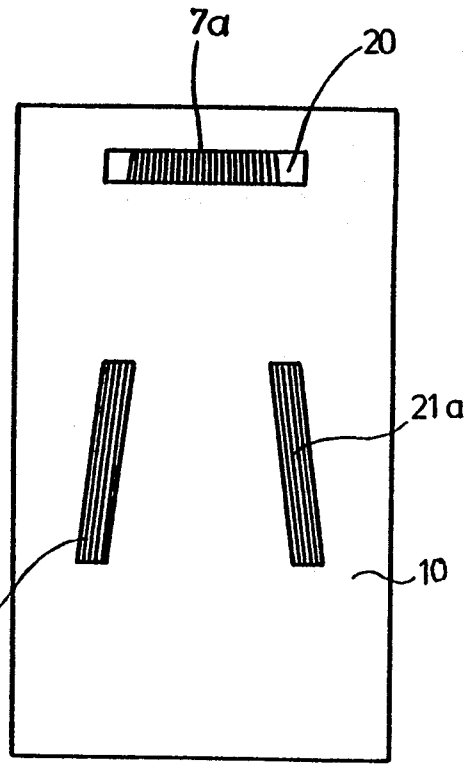
FIG. 7 is a bottom plan view of the structure shown in FIG. 6.
Figure 6:
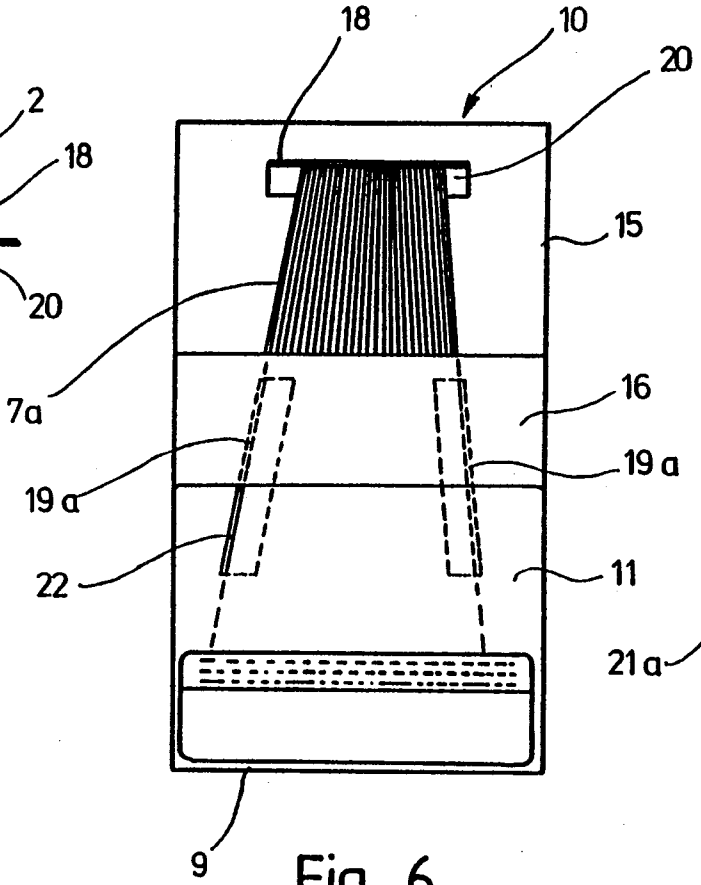
FIG. 6 is a top plan view of another preferred embodiment of the invention.

Turning to FIGS. 6 and 7, the second embodiment illustrated therein generally corresponds to the first embodiment of FIGS. 1–5. While, however, the needle packet 7 of the first embodiment has an essentially rectangular outline as viewed in top plan view, the needle packet 7*a* in the second embodiment has a trapezoidal configuration in top plan view. The reason for such a configuration is the fact that the knitting machine needles in the needle packet 7*a* are thicker in the zone of the knitting part 4 than in their butt zone.

Because of the trapezoidal outline of the needle packet 7*a* the lateral tabs 19*a* are convergent towards the transverse tab 18. They form an angle with the fold edge 9 other than 90°, for example, approximately 80°. Further, the lateral tabs 19*a* are provided not in the exposed zone 15 of the bottom panel 10 as in the first embodiment, but are cut and bent out from the bottom panel 10 underneath the top panel 11 and are thus disposed in the pouch 12. In the top panel 11 slots 22 may be provided (shown in broken lines in FIG. 6) which receive upper marginal portions of the tabs 19*a* to obtain an added lateral stability for the receptacle.

Figure 8:
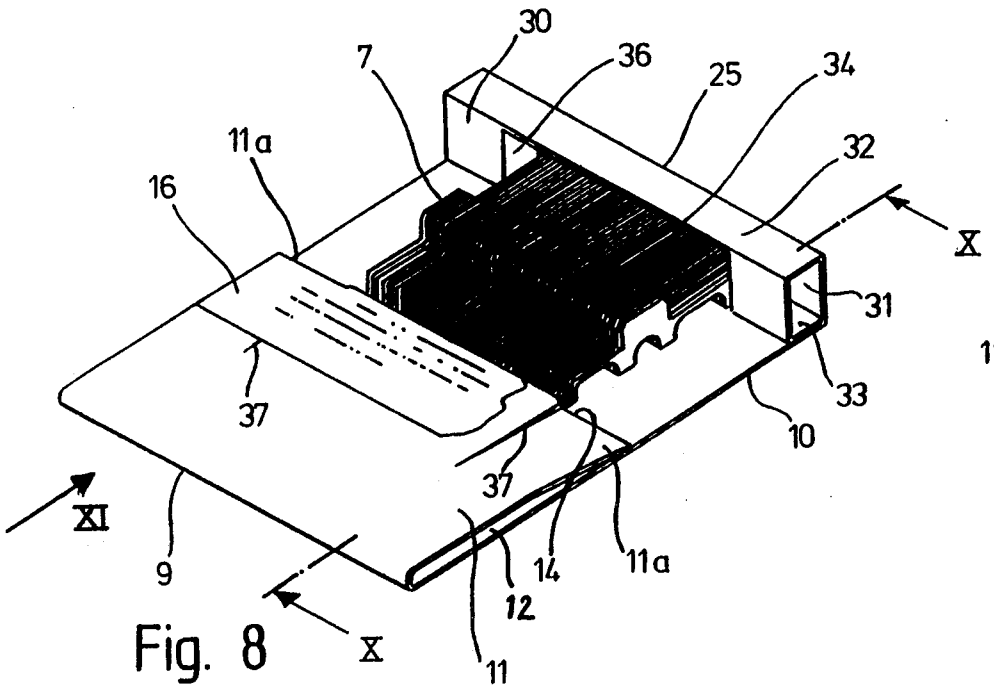
FIG. 8 is a perspective view of yet another preferred embodiment of the invention wherein adhesive strips are omitted in part.
Figure 14:
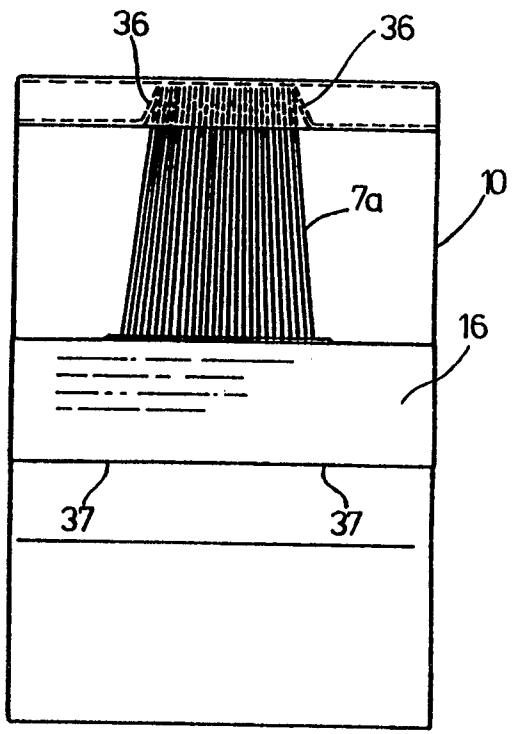
FIG. 14 is a top plan view of the construction shown in FIG. 13.
Figure 13:
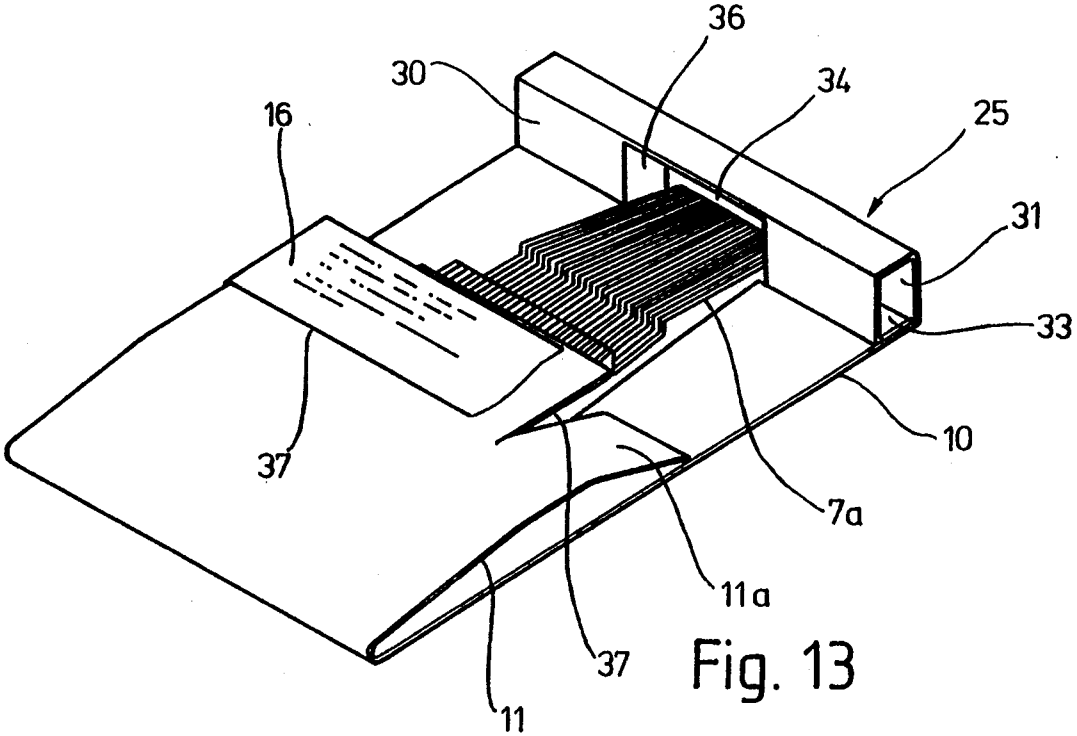
FIG. 13 is a perspective view of still another preferred embodiment of the invention with adhesive strips partially removed.
Figure 15:
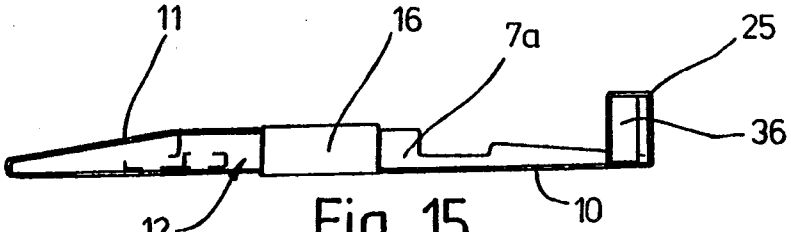
FIG. 15 is a side elevational view of the construction shown in FIG. 13.

The third embodiment illustrated in FIGS. 8–12 as well as the fourth embodiment shown in FIGS. 13–15 essentially correspond to the first embodiment of FIGS. 1–5 and to the second embodiment of FIGS. 6 and 7, respectively. While in the first embodiment the support of the end of the needle packet 7 is effected by the upwardly bent tab 18 cut from the bottom panel 10, in the third embodiment according to FIGS. 8–12 there is provided a housing portion 25 which projects upwardly from the bottom panel 10 and which has the general shape of a rectangular parallelepiped. As may be observed in FIG. 12, in the blank 8, the bottom panel 10 is adjoined by a flap 180 separated from the panel 10 by a fold line 26. In the flap 180 three additional fold lines 27, 28, 29 are provided which bound the sides 30, 31 and the top 32 of the box-like housing portion 25 as shown in FIG. 8. The fold line 29 adjacent the terminal edge of the receptacle blank 8 bounds a securing strip flap 33 which in the folded position is in a face-to-face engagement with the bottom panel 10 and is affixed thereto, for example, by gluing so that an overall stable housing portion 25 is obtained which is firmly attached to the bottom panel 10.

The upright side 30 of the housing portion 25 facing the removal opening 14 of the pouch 12 is provided with a rectangular receiving opening 34 which is bounded laterally by two parallel fold lines 35 (FIG. 12) which form the lateral edges of the receiving opening 34 and which are adjoined by a respective, trilaterally cut tab 36. In the upright positioned state the two tabs 36 are, as lateral guiding and positioning components for the needle packet 7, folded into the inside of the housing portion 25. The distance between the two fold lines 35 is greater than the width (the "gripping width") of the needle packet 7 and further, the two tabs 36 form, with the associated side wall 30 of the housing portion 25 an acute angle in such a manner that they laterally elastically yieldably support the needle packet 7 under the effect of their inherent elasticity.

Figure 10:
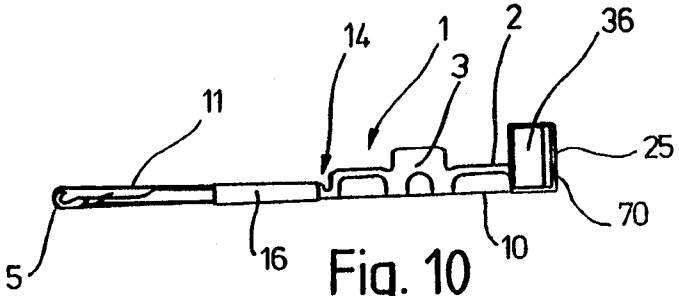
FIG. 10 is a sectional view taken along line X—X of FIG. 8.

As seen in FIG. 10, the height of the receiving opening 34 is greater than the height of the needle shank part 70 accommodated in the inside of the housing portion 25. This feature ensures that individual needles 1 or the entire needle packet 7 may be removed in a simple manner from the receptacle without destroying the housing portion 25. The latter merely needs to be elastically bent downwardly together with the bottom panel 10 so that the end of the needle packet 7 is freed through the receiving opening 34 from the folded-away housing portion 25.

The lateral guidance of the needle packet 7 is effected additionally to the tabs 36 by means of lateral guiding and positioning components in the zone of the top panel 11. For this purpose, in the panel 11 two parallel cuts 37 are provided which extend from the removal opening 14 and whose distance from one another approximately corresponds to the width of the needle packet 7. The zones 11*a* which form part of the top panel 11 and which are separated therefrom by the respective cuts 37, are situated laterally of the needle packet 7 and are, similarly to the FIG. 1 construction, connected with the bottom panel 10 by an adhesive strip 16. The latter may also function as a label and may extend over the entire width of the top panel 11. In principle it is feasible to affix the zones 11*a* of the top panel 11 to the bottom panel 10 directly, that is, without height spacing, for example, by means of gluing or stapling.

As it may be observed particularly in FIG. 8, if a needle packet 7 is in place in the receptacle, the zone of the top panel 11 which is situated between the two cuts 37 is, with respect to the slightly downwardly bent zones 11*a*, spread upwardly, whereby at the cuts 37 the lateral edges of the two zones 11*a* are exposed and lie laterally against the needle packet 7, guiding and positioning (supporting) the latter.

The receptacle according to the embodiment illustrated in FIGS. 13–15 is particularly adapted for packaging transfer needles. As particularly well seen in FIG. 13, the width of the receiving opening 34 is, because of the generally trapezoidal outline of the needle packet 7*a*, smaller than the distance between the two cuts 37 in the top panel 11. The cuts 37 are not parallel; rather, they form a small acute angle with one another corresponding to the shape of the needle packet 7*a*. The other parts of the receptacle are identical to the two embodiments of FIGS. 5, 6 and 8–11.

In principle, it is feasible to provide bent-out lateral tabs similar to tabs 19 in the embodiments according to FIGS. 8–12 and 13–15. Likewise, the embodiments of FIGS. 1–5 and 6, 7 may be provided with cuts 37 in which case the tabs 19 may be omitted.

The needle receptacle according to the invention may be used for a great variety of knitting machine needles or generally for knitting tools. Thus, the receptacles may be utilized not only for stamped latch needles but also for transfer needles, springbeard needles and the like.

For removing the needles 1 from the receptacle, merely the bottom panel 10 has to be bent slightly downwardly at its end, whereupon the needles may be pulled out of the pouch 12 over the elastically yielding tab 18 (first and second embodiments) or the downwardly bent housing portion 25 (third and fourth embodiments).

The receptacles filled with the needles may be positioned in a collecting box or the like, or they may be individually or in groups welded into plastic sheets. The embodiments according to FIGS. 8–12 and 13–15 are particularly adapted for stacking. In the stacked state the receptacles are alternately turned 180°, so that they are in engagement with one another such that the housing portions 25 are alternately oriented upwardly and downwardly.

It will be understood that the above description of the present invention is susceptible to various modifications, changes and adaptations, and the same are intended to be comprehended within the meaning and range of equivalents of the appended claims.

What is claimed is:

1. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining an end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle;

(c) lateral tab means cut out and/or bent out from and integrally attached to said sheet for laterally guiding and positioning the contents; said lateral tab means including at least two lateral tabs being spaced from one another in a direction parallel to said transverse folding edge and each being oriented at an angle other than 90° to said transverse folding edge; and (d) connecting means for attaching the longitudinal lateral edges of said bottom and top panels to one another at transversely opposite zones.

2. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining an end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle;

(c) lateral tab means cut out and/or bent out from and integrally attached to said sheet for laterally guiding and positioning the contents; said tab means comprising two cuts provided in said top panel; said cuts extending from said removal opening and being spaced from one another in a direction parallel to said transverse folding edge at a distance approximately corresponding to an expected width of the contents; said cuts defining separated lateral top panel portions bent towards said bottom panel and being secured thereto; and (d) connecting means for attaching the longitudinal lateral edges of said bottom and top panels to one another at transversely opposite zones.

3. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining an end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle;

(c) lateral tab means cut out and/or bent out from and integrally attached to said sheet for laterally guiding and positioning the contents; said lateral tab means being situated in said pouch and being cut out and bent out from and integrally attached to one of said bottom and top panels and is received in slots provided in the other of said bottom and top panels; and (d) connecting means for attaching the longitudinal lateral edges of said bottom and top panels to one another at transversely opposite zones.

4. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining an end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle;

(c) lateral tab means cut out and/or bent out from and integrally attached to said sheet for laterally guiding and positioning the contents; and (d) connecting means for attaching the longitudinal lateral edges of said bottom and top panels to one another at transversely opposite zones situated solely at locations spaced from said transverse folding edge; said connecting means comprising at least one adhesive strip connecting an outer face of said top panel with an outer face of said bottom panel and straddling the longitudinal lateral edges of said bottom and top panels in a U-shaped manner.

5. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining a first end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle; said receptacle having a second end remote from said first end;

(c) connecting means for attaching the longitudinal lateral edges of said bottom and top panels to one another at transversely opposite zones;

(d) a housing portion situated at said second end and extending parallel to said transverse folding edge; said housing portion projecting from said bottom panel and being formed from a multiply-folded flap constituting part of said flexible sheet; said housing portion having a side wall oriented towards and spaced from said removal opening; said side wall of said housing portion having a receiving opening for allowing passage of one part of the contents into said housing portion; and (e) lateral tab means cut out and/or bent out from and integrally attached to said sheet for laterally guiding and positioning the contents; said lateral tab means including two lateral tabs cut out and/or bent out from and integrally attached to said side wall of said housing portion at opposite lateral sides of said receiving opening; said lateral tabs projecting into said housing portion.

6. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining a first end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle; said receptacle having a second end remote from said first end;

(c) lateral tab means cut out and/or bent out from and integrally attached to said sheet for laterally guiding and positioning the contents;

(d) connecting means for attaching the longitudinal lateral edges of said bottom and top panels to one another at transversely opposite zones; and (e) a rectangular parallelepiped-shaped housing portion situated at said second end and extending parallel to said transverse folding edge; said housing portion projecting from said bottom panel and being formed from a multiply-folded flap constituting part of said flexible sheet; said housing portion having a side wall oriented towards and spaced from said removal opening; said side wall of said housing portion having a receiving opening for allowing passage of one part of the contents into said housing portion.

7. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining an end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle;

(c) lateral tab means cut out and/or bent out from and integrally attached to said sheet for laterally guiding and positioning the contents; and (d) connecting means for attaching the longitudinal lateral edges of said bottom and top panels to one another at transversely opposite zones situated solely at locations spaced from said transverse folding edge; said transversely opposite zones being situated at said removal opening.

8. The packing and storing receptacle as defined in claim 7, wherein said sheet is a cardboard.

9. The packing and storing receptacle as defined in claim 7, wherein said connecting means includes means for directly connecting said top and bottom panels to one another at the longitudinal lateral edges thereof.

10. The packing and storing receptacle as defined in claim 7, wherein said lateral tab means is cut out and/or bent out from and integrally attached to said bottom panel.

11. The packing and storing receptacle as defined in claim 10, wherein said lateral tab means is situated in said pouch.

12. The packing and storing receptacle as defined in claim 7, wherein said top panel is shorter than said bottom panel.

13. The packing and storing receptacle as defined in claim 12, wherein said bottom panel has a freely exposed zone adjoining said pouch.

14. The packing and storing receptacle as defined in claim 13, further comprising a transverse tab cut out and/or bent out from and integrally attached to said bottom panel in said freely exposed zone at a distance from said removal opening for abutting an end of the contents partially received in said pouch and partially supported on said freely exposed zone; said transverse tab being oriented substantially parallel to said transverse folding edge.

15. The packing and storing receptacle as defined in claim 13, wherein said lateral tab means is disposed in said freely exposed zone.

16. A packing and storing receptacle particularly for knitting needles, comprising (a) a bottom panel;

(b) a top panel superposed on the bottom panel and defining a pouch therewith for receiving at least a longitudinal part of contents; said bottom and top panels being formed by a single, flexible sheet and being separated from one another by a transverse folding edge defining an end of the receptacle; said top panel having a terminal edge remote from said transverse folding edge and defining, together with said bottom panel, a removal opening of said pouch; said bottom and top panels having longitudinal lateral edges extending generally perpendicularly to said transverse folding edge along a length dimension of said receptacle;

(c) two upstanding lateral tabs cut out and/or bent out from and integrally attached to said sheet for laterally guiding and positioning the contents; said lateral tabs being spaced and fully separated from one another in a direction parallel to said transverse folding edge and each having flat tab areas being oriented perpendicularly to said transverse folding edge; and (d) connecting means for attaching the longitudinal lateral edges of said bottom and top panels to one another at transversely opposite zones.

17. The packing and storing receptacle as defined in claim 16, wherein said housing portion has a securing flap formed on said side wall thereof, said securing flap being attached to said bottom panel.

* * * * *